US005674045A

United States Patent [19]

Eckloff et al.

[11] Patent Number: 5,674,045

[45] Date of Patent: Oct. 7, 1997

[54] MANHOLE COVER MOVING APPARATUS AND METHOD

[75] Inventors: Donald Eckloff; Martin C. Pettesch, both of Cranford, N.J.

[73] Assignee: Universal Valve Co., Inc., Elizabeth, N.J.

[21] Appl. No.: 321,209

[22] Filed: Oct. 11, 1994

[51] Int. Cl.[6] ..... G66F 11/00

[52] U.S. Cl. ..... 414/684.3; 254/133; 254/100; 254/7 R; 254/4 R

[58] Field of Search ..... 414/684.3; 294/15, 294/17; 254/131, 133 R, 4 R, 7 R, 100; 280/63, 79.11

[56] References Cited

U.S. PATENT DOCUMENTS

| | | | |
|---|---|---|---|
| 1,083,182 | 12/1913 | Bean | 254/133 R |
| 1,336,291 | 4/1920 | Gilmore | 254/100 X |
| 2,655,399 | 10/1953 | McMillan | 294/17 |
| 3,270,407 | 9/1966 | Araujo | 254/100 X |
| 3,885,688 | 5/1975 | Larsen | 254/131 X |
| 4,076,217 | 2/1978 | Haller et al. | 254/131 |
| 4,181,290 | 1/1980 | Affolter | 254/124 |
| 4,261,548 | 4/1981 | Kaderabek | 254/131 |
| 4,746,098 | 5/1988 | Abaratin | 254/130 |
| 4,838,521 | 6/1989 | Moisan | 254/131 |
| 5,165,661 | 11/1992 | Wright | 254/131 |
| 5,184,422 | 2/1993 | Wade et al. | 49/239 |
| 5,292,107 | 3/1994 | Chick | 254/131 |

FOREIGN PATENT DOCUMENTS

| | | | |
|---|---|---|---|
| 61-169403 | 7/1986 | Japan . | |
| 61-176721 | 8/1986 | Japan . | |
| 61-207727 | 9/1986 | Japan . | |
| 162940 | 9/1933 | Switzerland . | |
| 247943 | 1/1948 | Switzerland . | |
| 2111017 | 6/1983 | United Kingdom | 254/131 |

*Primary Examiner*—Donald W. Underwood
*Attorney, Agent, or Firm*—Edward Dreyfus, Esq.

[57] ABSTRACT

A lifting and moving portable apparatus and method that includes a beam extending across the manhole cover supported at one end by a pivot member resting on the surface outside the manhole periphery and supported at the other end by a pair of wheels riding on the surface outside the manhole periphery. A lifting device is mounted on the center region of the beam for securing the cover and lifting the cover above the cover rim or surrounding surface. Once lifted, the operator can roll the beam and cover assembly through an arc about the pivot axis to expose the entire manhole. Means are provided to stabilize the cover in the horizontal and angular position relative to the beam so that the cover assumes the same angular position relative to the manhole when returned to the closed position.

8 Claims, 6 Drawing Sheets

MANHOLE COVER MOVING APPARATUS AND METHOD

BACKGROUND

The present invention relates to manhole covers of the type for covering manholes in streets, surfaces at gasoline service stations, and the like and more particularly to a method and apparatus for moving the cover to and from a closing position over the manhole.

Manholes comprise three basic elements, namely, a ring or rim serving as a top lip of the manhole, a skirt connected to and below the ring to form a partially enclosed chamber or hole, and a cover to cooperate with the ring for removably covering the chamber.

The size and weight of manhole covers have increased throughout the last several decades. Today, 36, 42, and 48 inch diameter or cross length are common with thickness of ½ and ⅜ (stiffened) inches. Covers are sometimes made of diamond plate steel and can weigh as much as 400 pounds.

Many techniques for raising and moving manhole covers have been tried to aid the operator. Beams, levers, frames, and hoists have all been tried but with essentially no acceptance in the field primarily because of the bulk and size of these aids that require movement and storage at the station or on the service truck.

Therefore, large covers today are still manually raised and dragged to the side, causing risk of injury to the operator. Also, because many covers have precisely positioned features, the operator must replace the cover in a precise angular position over the manhole, which placement is quite difficult with an unaided cover.

The present invention provides a new method and apparatus for raising and moving the manhole covers that avoids the problems of the prior art and provides other and further advantages and benefits.

SUMMARY OF PREFERRED EXEMPLARY EMBODIMENTS OF THE PRESENT INVENTION

A preferred exemplary apparatus according to the principles of the present invention comprises an elongated beam or channel member having a length greater than the diameter or greatest cross dimension of the cover. Preferably two wheels or casters are mounted to provide a rolling support for one portion of the channel member. A vertical support member or pivot member is mounted to support another part of the channel member, the pivot member being spaced from the wheels and having a bottom which during operation becomes stationary with the surface adjoining the manhole and provides a vertical axis of rotation for the channel member.

The wheels are preferably spaced from each other and positioned on opposite sides of the channel member generally along an arc having an axis defined by the pivot member.

A cover lifting device is mounted on or can cooperate with the channel member for lifting the cover above the rim. The lifting device comprises an assembly that provides the operator mechanical advantage so that the operator need not directly lift the weight of the cover. In one example, the lifting device comprises a lever arrangement facilitating cover lifting with small operator forces applied. In another example, the device comprises a threaded member cooperating with the channel member and detachably threaded into the cover. The threaded member can be rotated with a standard ratchet or socket wrench as desired.

Once lifted, the weight of the cover causes the base of the pivot member to become stationary with the adjoining surface. The channel member is rolled through a horizontal arc about the pivot member to exposed all or any portion of the manhole chamber.

To replace the cover in the precise angular position, the channel member is rotated to its original orientation above the manhole, then lowered and released by the lifting device.

An exemplary method according to the principles of the present invention includes acquiring and raising the cover from its closed position to a position above the rim and distributing the weight of the cover to the top surface adjoining the manhole in at least two spaced support zones, rotating the cover through a horizontal arc about a vertical axis located outside the periphery of the cover, said axis extending through one of said support zones, and rotating the second support zone through an arc having the same axis of rotation as said cover. In this way the cover can be rotated away from the manhole to provide access to the entire chamber, if desired.

To replace the cover in the precise angular closed position, the cover and second mentioned support zones are rotated back through the arc about the same axis through the first mentioned support zone until the cover is located above the manhole. The cover is then lowered into its closed position and released.

DRAWINGS

Various advantages and benefits will be understood from the following detailed description of preferred exemplary embodiments of the present invention when taken in view of the appended drawings in which.

DETAILED DESCRIPTION OF PREFERRED EMBODIMENTS

Figure 1:
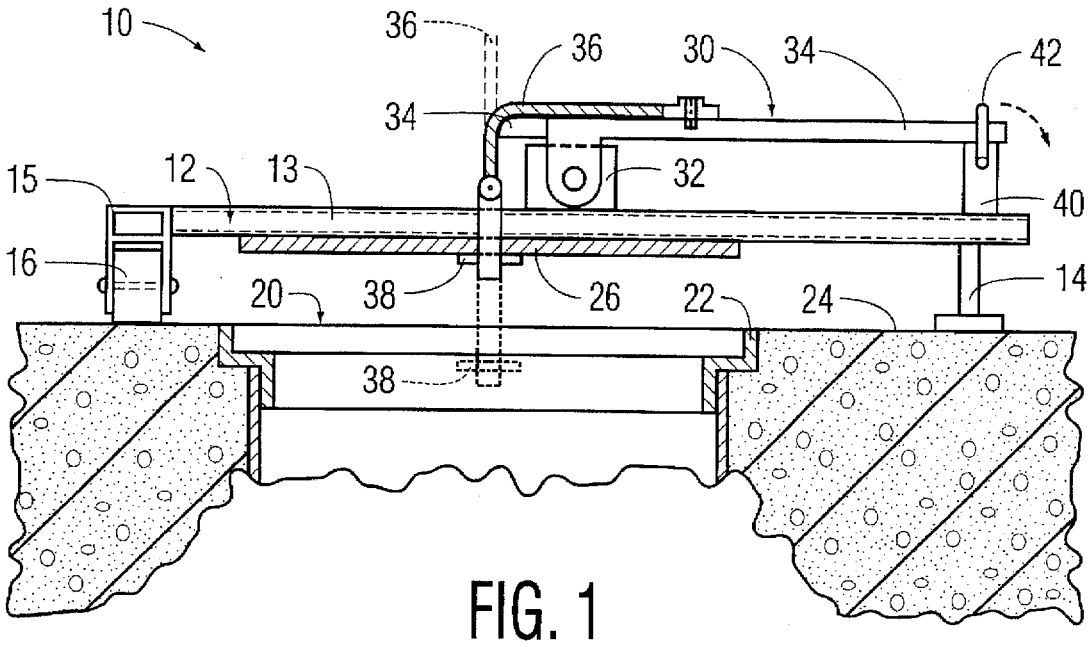
FIG. 1 is a vertical sectional representation of a preferred embodiment manhole cover lifter/mover according to the principles of the present invention.
Figure 2:
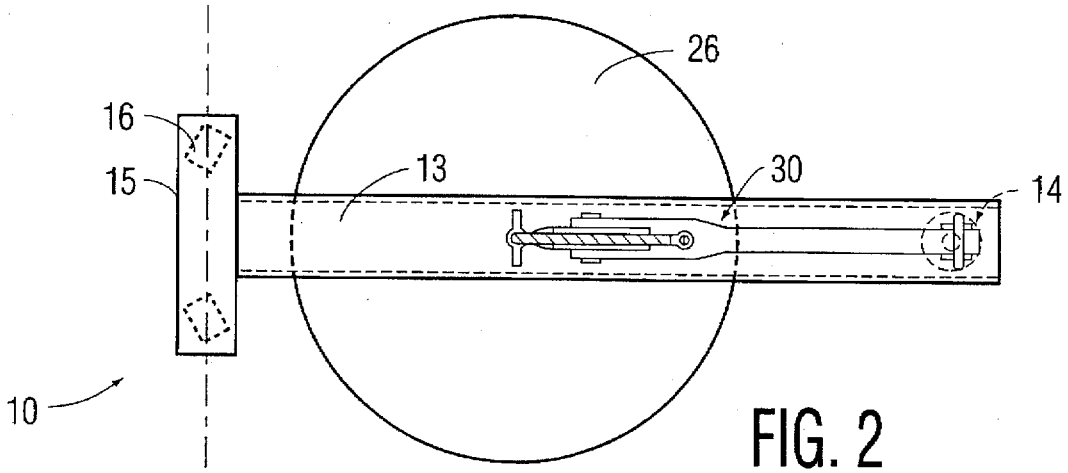
FIG. 2 is a plan view of FIG. 1.
Figure 3:
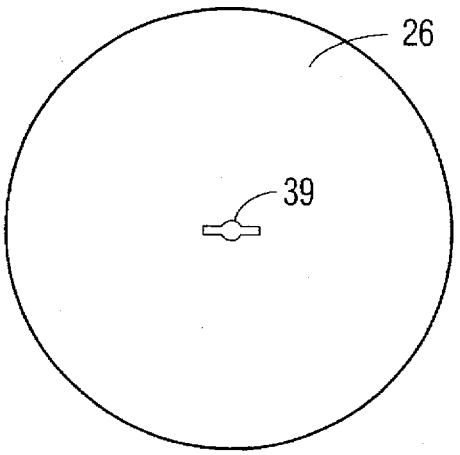
FIG. 3 is a plan view of a cover that can cooperate with the lifter/mover of FIG. 1.

With reference to FIGS. 1–5, a typical manhole 20 includes a rim 22 embedded in a road surface material or other conventional material such as concrete, as shown. In the illustrated example the rim 22 to is flush with the adjoining surface 24. Cover 26, in this example, is round and when in the closed position rests on the recessed lip of rim 22 so that the upper surface of cover 26 is flush with the adjoining surface 24.

One embodiment 10 of a lifter/mover according to the principles of the present invention, comprises a hollow beam or channel member 12 having an elongated beam 13 and a cross beam 15 welded or otherwise secured to one end of beam 13. A vertical column or pivot 14 is mounted near the free end of beam 13 and mounted for rotation to the underside thereof. Pivot 14 functions to provide vertical support and a vertical axis for rotation of beam member 12.

A pair of rollers, casters, or wheels 16 are positioned on the cross beam 15 and on opposite sides of the axis of beam 13 and secured to roll on the adjoining surface while supporting the weight of the cover/beam member assembly as described below. It is preferred that the wheels be fixed for rolling through or in a horizontal arc with its center axis generally extending through the pivot 14. Alternately, wheels 16 can be freely rotating in caster fashion because they will tend to assume alignment about said arc when beam member 12 is rotated because of the stationary position of pivot 14 during the cover lifting and moving operations.

A cover lifting device 30 is mounted to the top of beam 13 and serves to provide the operator with mechanical advantage for lifting the cover. Device 30 in the example shown includes a lever arm 34 coupled rotatably to beam 13 by bracket cam 32, the latter defining a cam shoulder 34. A steel, nylon, or other suitable cable 36 has one end fastened to the mid-length of lever 34 and its free end connected to pin assembly 38 that extends downward through the beam 13 to below the underside thereof. As lever 34 is raised to its vertical position, pin 38 lowers to below the lower surface of the cover when in its in the closed position, as shown in phantom in FIG. 1. Pin assembly travels through an eye slot 39 in cover 26. Once below the cover, pin assembly 38 can be turned 90 degrees by hand to prevent withdrawal of the pin. Lever 34 can then be rotated to the locked position shown in FIG. 1, thus raising cable 34 and cover 26 so that cover 26 upper surface engages the underside of beam 13. In one example, the cover need only be raised 4 inches from its closed position to engage the underside of beam 13. The free end of lever 34 rests on block 40 and safety latch 42 rotates to secure the same thereto.

Figure 4:
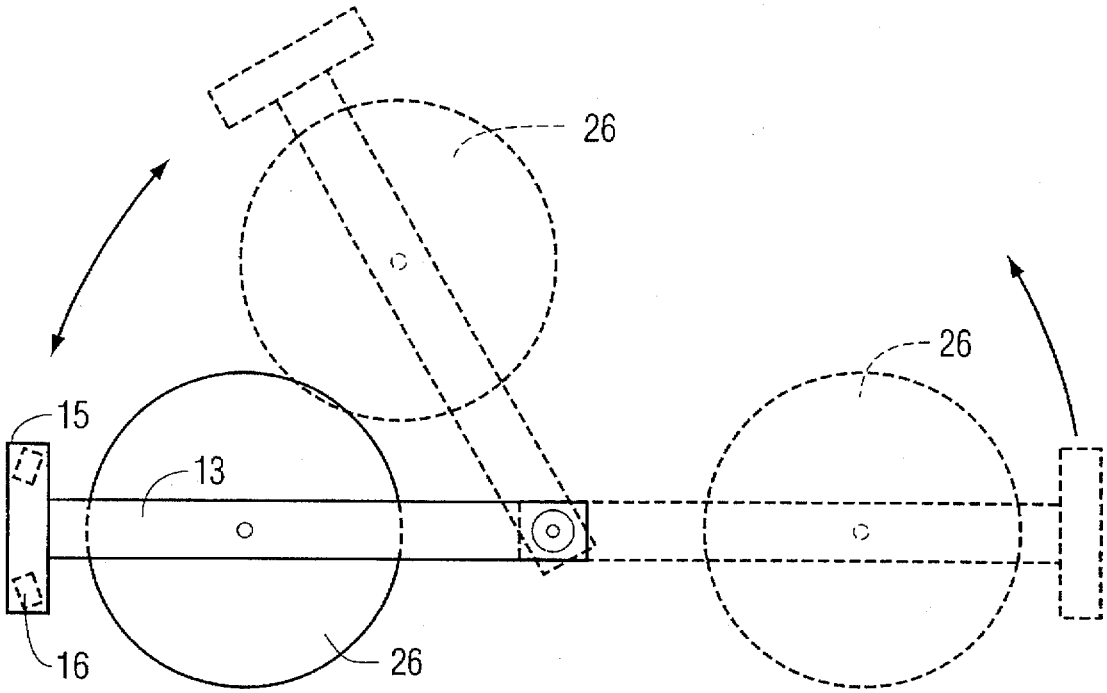
FIG. 4 is a schematic representation of the mover/lifter of FIG. 1 in various rotational positions relative to the manhole.
Figure 5:
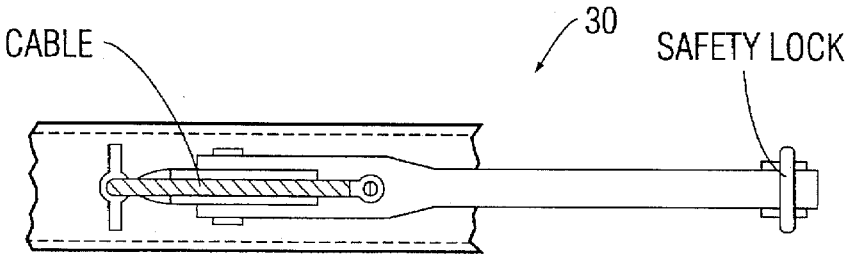
FIG. 5 is a partial plan view of the lifting device of FIG. 1.
Figure 6:
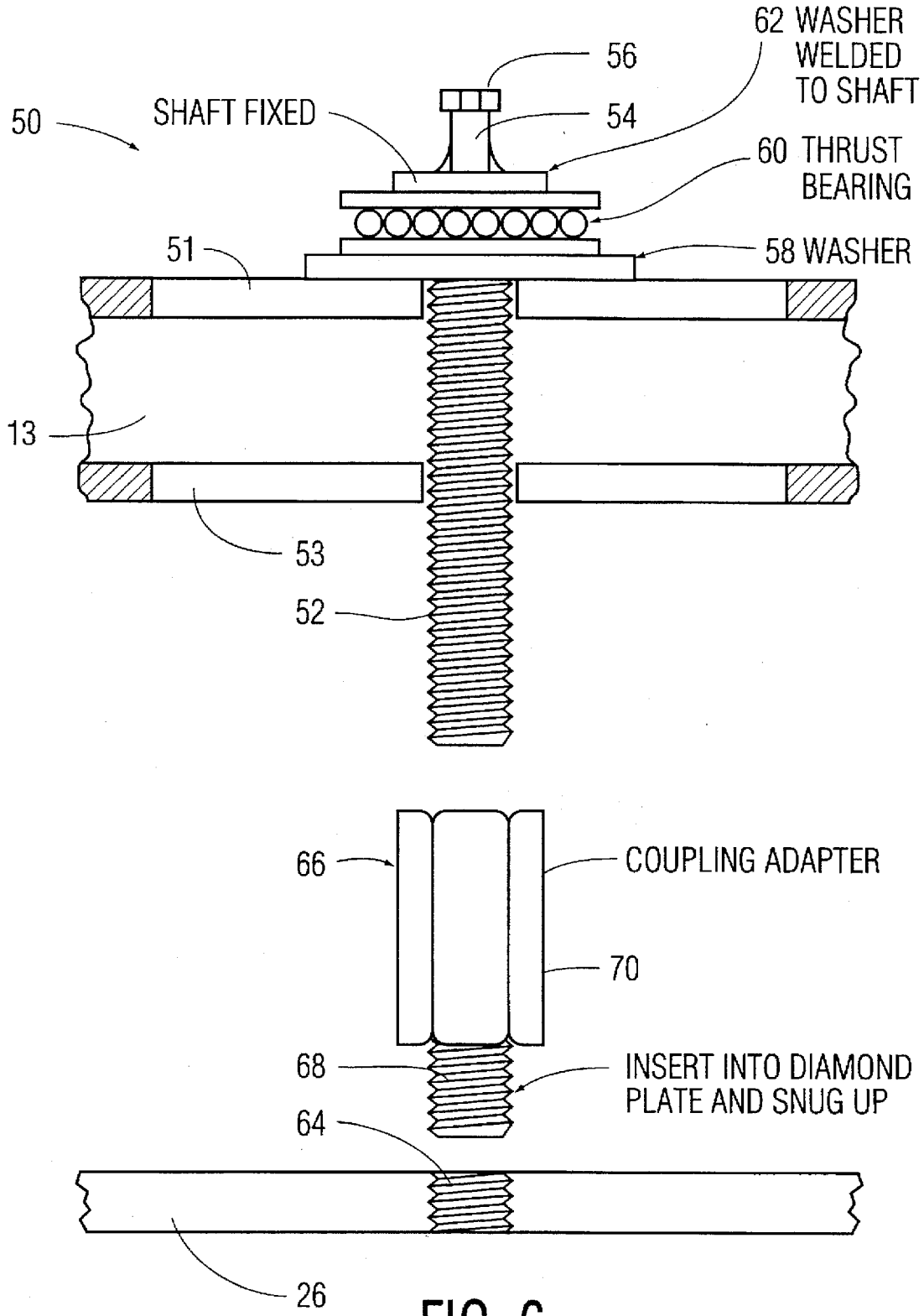
FIG. 6 is a partial disassembled vertical section of an alternate lifter.

To enable access to the manhole chamber, the operator need only push laterally on cross beam 15. The weight of the cover 26 causes greater engagement between the base of pivot 14 and the adjoining surface so that base of pivot 14 remains stationary while beam 13 rotates about the axis defined by pivot 14. Beam 12 rotation could be in either direction. As seen in FIG. 4, the cover profile will clear the manhole entirely, if desired, to enable full access to the manhole chamber. It should be understood that cover 26 does not rotate relative to beam member 12 and that the plane of cover 26 is stabilized because of the engagement between the top of cover 26 and the underside of beam 13.

To replace the cover in its closed position, the operator need only apply lateral force on cross beam 15 to rotate the cover/beam member assembly through the horizontal arc about pivot 14 until the cover is again in the ready position over the manhole. Latch 42 is released, lever 34 raised to lower cover on to the inside lip of rim 22. Once the weight of cover 26 is held by the rim, the pin assembly 38 can be turned by hand and withdrawn through slot 39 in the cover. To prevent rain water or other liquids from entering the manhole, a removeable plastic plug can to inserted into slot 39 in the conventional manner.

The lifter/mover 10 can now be carried away for storage. In one example, the beam member is made of extruded aluminum in a box construction. The weight of the entire lifter/mover should approximate 20 pounds. Because of the light weight, the lifter/mover 10 can be easily and quickly positioned with the pin assembly above the slot 39 to initially engage the cover 26. If desired, the beam 13 can be made of two telescoping sections (not shown) in order reduce the length of the product when not in use.

With reference to FIGS. 6–9, there is shown an alternate embodiment of the lift/mover according to the principles of the present invention. Instead of the lever type device as shown in FIG. 1, this embodiment provides slots 51 and 53 in the top and bottom of beam 13 that extend longitudinally along beam 13. Lifting device 50 comprises a threaded shaft or bolt member 52 having a smooth shaft 54 at its top end. A hex-nut or other suitably shaped top 56 is secured to the top of shaft 54 to cooperate with a socket wrench or other type of turning tool, not shown. Washer 62 is welded or otherwise secured to shaft 54 and thrust bearing 60 and washer 58 are arranged on shaft 54 to freely rotate thereon.

The cover 26 of this embodiment defines preferably in its center region a threaded opening 64 that extends partially or completely through cover 26. A coupling adaptor 66 includes threaded lower part 68 for mating with the threads of opening 64 and a female coupling 70 cooperating with the threaded member 52.

Figure 7:
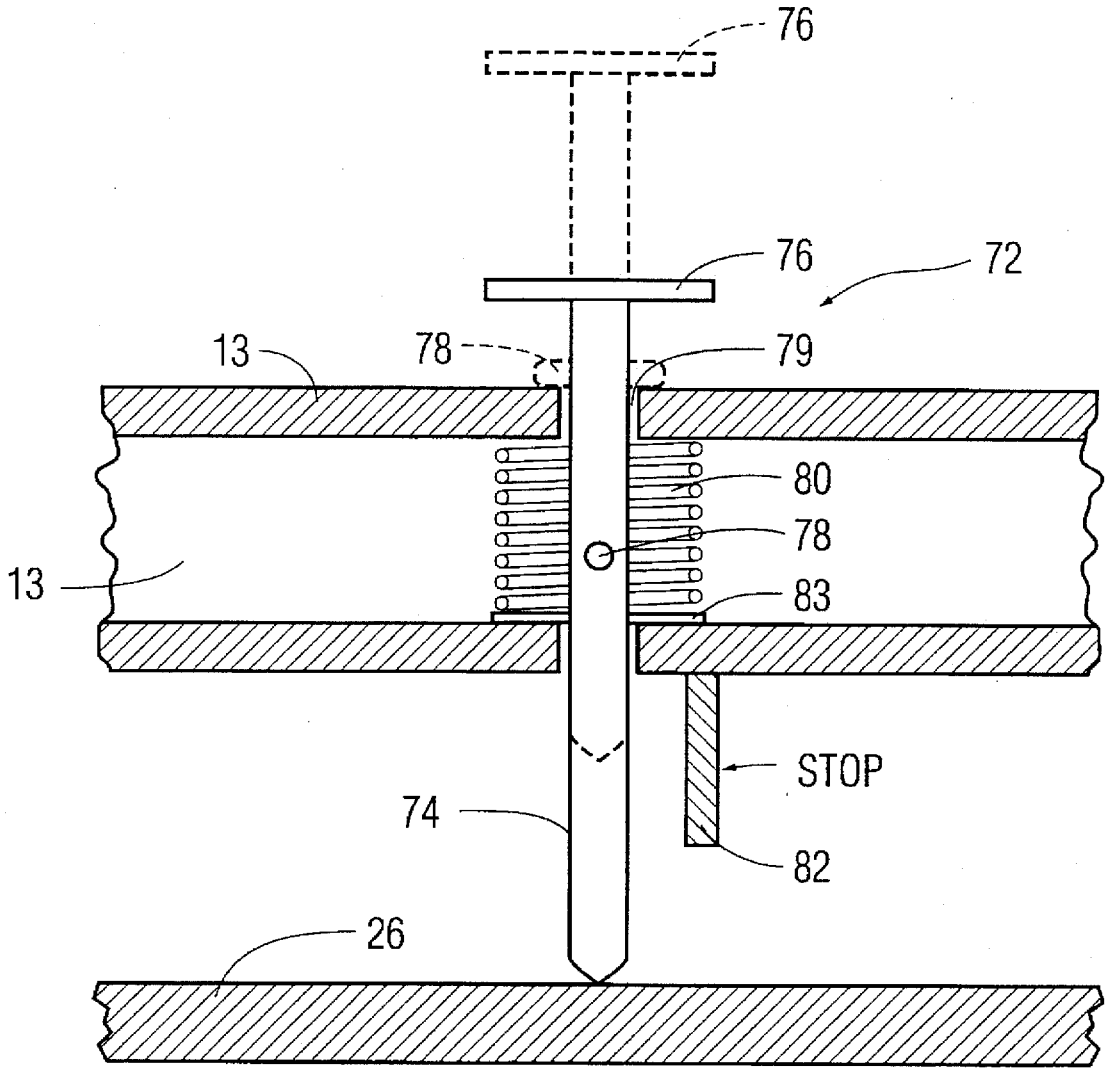
FIG. 7 is a partial section of a cover rotation preventor.
Figure 8:
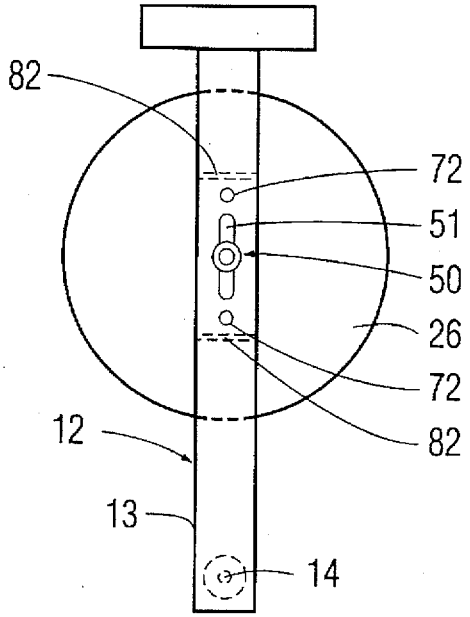
FIGS. 8 and 9 are plan views of alternate arrangements of the present invention.

As better seen in FIGS. 7 and 8, a cover rotation preventor 72 is mounted on the beam 13 at either side of the slot 51 to prevent the cover from rotation when lifted by bolt 52. These preventors include a pin 74 having a finger knob 76 at its top. Washer 83 is welded to shaft 74 to cooperate with spring 80 to bias pin 74 to its lower, stop position. Pin 74 also defines a pair of pins 78 between the top and bottom of beam 13. The knob 76 and pins are raised against the bias of spring 80 until pins 78 clear through key slot 79 then turned 90 degrees to lock pin 74 in its stored position until needed. In this way, pins 74 do not interfere with the positioning of the apparatus 12 in the precise position relative to the opening 64. Also, the lifting device 50 can be moved along slots 51 and 53 to assist in this positioning. Also, stop members 82 are secured to the underside of beam 13 to assist in stabilizing the cover being raised.

In operation, the beam is positioned with the slots 51 and 53 extending across the plane of opening 64. Coupling 70 is threaded into opening 64. Bolt 52 in inserted through the slots 51 and 53 and aligned with coupling 70 and finger tightened to mate therewith. Once washer 58 contacts beam 13, a ratchet tool can be used to engage nut 56 and rotate bolt 52 clockwise. Bearing 62 enables rotating of washer 54 relative to washer 58 and beam 13. Bolt 52 therefore continues to rotate thus lifting adaptor 70 and cover 26 with great mechanical advantage.

As the cover rises, pins 74 prevent rotation and are forced upward against springs 80 until one edge or the other contacts stop 82. As bolt 52 continues to turn, the cover will flatten or move to the horizontal plane until the other stop member 82 is engaged. The apparatus 12 can then be rotated to expose the manhole as described above.

To replace the cover in the closed position, the lifter/mover 12 is rotated back to the position shown in FIG. 8, a tool is used to turn nut 56 in the opposite direction to lower cover 26 back to its closed position. Pins 74 maintain contact and prevent rotation of the cover relative to the beam 13. Once in the closed position, bolt 52 is turned free of adaptor 70 and adaptor 70 is unscrewed from the cover. A plastic plug (not shown) can be inserted in opening 64 to prevent water from entering the manhole.

Figure 9:
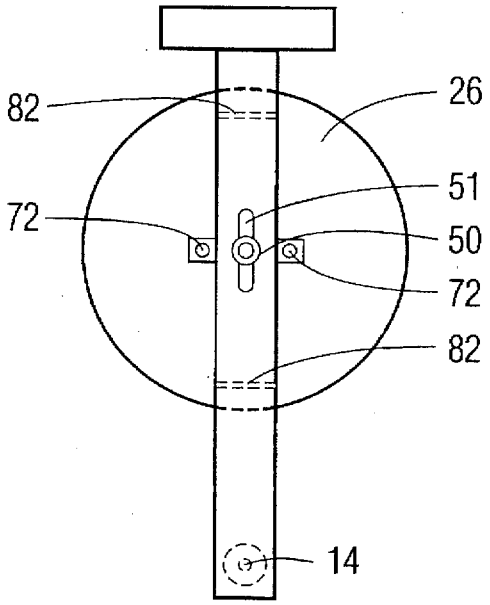

An alternate location of rotation preventors 72 is shown in FIG. 9 where they are located on flanges extending on either side of beam 13 near the lifting device 50. In this way the operator has all the parts the operator needs to adjust together for his/her convenience.

Figure 10:
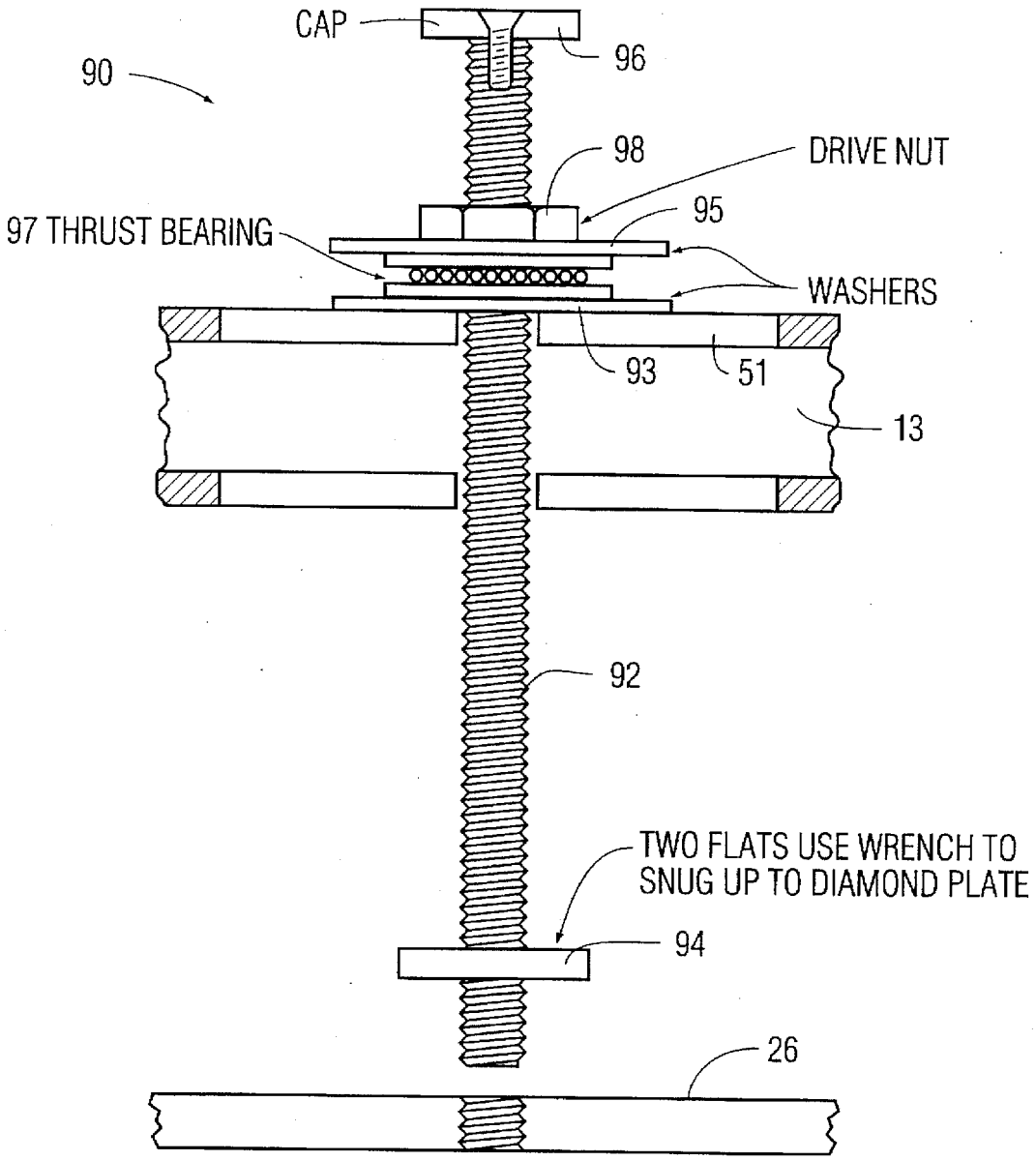
FIG. 10 is a view similar to FIG. 6 of an alternate lifter.
Figure 11:
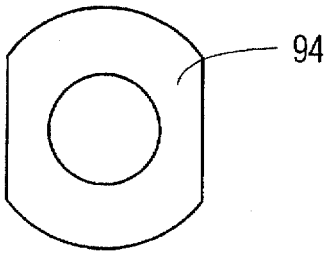
FIG. 11 is a plan view of nut member 94 of FIG. 10.

An alternate lifting device 90 is shown in FIG. 10 includes a threaded shaft or bolt threaded throughout its length. A drive nut 98 is threaded for rotation on the bolt 92. Washers 98 and 93 sandwiching thrust bearing 97 are provided as shown, all free to rotate on bolt 92. A threaded nut member 94 is threaded on to bolt 94.

In operation, the device 90 is lowered through slots 51 and 53 in beam 13. Nut member 94 is threaded on to bolt 92. Bolt 92 is then threaded in to opening 64 until nut 94 contacts cover 26 at which point a wrench or tool is preferably used to tighten nut 94 firmly against cover 26. Then a wrench or tool is used to turn drive nut 98 thus raising bolt 92. Cover 26 is held from rotating by preventors mentioned above and the cover is raised and lowered in response to the turning of nut 98.

It will be understood that various changes and modifications can be made to the herein disclosed embodiments of the present invention without departing from the spirit and scope of the present invention.

We claim:

1. An apparatus for removing a cover from a closed position on a manhole having a rim, moving the cover to expose the manhole for access thereto, and replacing the cover to a closed position on the manhole, the apparatus comprising:

cover securing means for releasably securing and raising the cover from its closed position to a position above the manhole rim and for lowering and releasing the cover to its closed position, first and second means for distributing the weight of the cover to a top surface adjoining the manhole in respective first and second support zones spaced from each other, said first means comprising at least one friction reducing means for contacting the top surface and enabling substantially friction free movement between said securing means and the top surface, an elongated member for supporting said securing means above the cover and being supported by and coupled to said first and second means so that the cover and said first means are moveable through arcs about a vertical axis located outside the periphery of the manhole, and wherein said securing means comprises an elongated threaded member extending vertically through an opening in said elongated member at a location between said first and second means and mounted on said elongated member for rotation into threaded coupling with a threaded opening of the cover to secure the cover therewith, the portion of said threaded member above the elongated member comprising a device adapted to be engaged by a tool for rotating the threaded member in first and second angular directions, and wherein said opening in said elongated member comprises a slot for longitudinally adjusting the position of the threaded member on said elongated member, a bearing means having a dimension greater than said slot coupled to said threaded member for reducing the turning forces needed to rotate the threaded member mounted on said elongated member and for distributing the weight of the cover to said elongated member when the cover is raised and supported by the threaded member.

2. An apparatus according to claim 1, wherein said threaded member threads directly into the opening of the cover, a lock nut threaded on said threaded member to lock the cover and threaded member together, and a drive nut threaded to said threaded member above said bearing member to raise and lower the threaded member when said drive nut is turned by a tool.

3. An apparatus according to claim 1, further comprising a threaded coupler threadable into the threaded opening of the cover, said coupler having an upstanding threaded adaptor portion, and wherein said threaded member is threadable directly into said threaded adaptor portion, and a tool engaging device connected to the top portion of said threaded member above said bearing member to raise and lower the threaded member when said tool engaging device is turned by a tool.

4. An apparatus for removing a cover from a closed position on a manhole having a rim, moving the cover to expose the manhole for access thereto, and replacing the cover to a closed position on the manhole, the apparatus comprising:

cover securing means for releasably securing and raising the cover from its closed position to a position above the manhole rim and for lowering and releasing the cover to its closed position, first and second means for distributing the weight of the cover to a top surface adjoining the manhole in respective first and second support zones spaced from each other, said first means comprising at least one friction reducing means for contacting the top surface and enabling substantially friction free movement between said securing means and the top surface, an elongated member for supporting said securing means above the cover and being supported by and coupled to said first and second means so that the cover and said first means are moveable through arcs about a vertical axis located outside the periphery of the manhole, means for maintaining the cover at the same angular position relative to the elongated member during the raising and horizontal moving of the cover, and wherein said last mention means includes a pair of rod members spaced from each other and coupled to said elongated member and extending below the bottom of the elongated member, a spring bias means biasing said rod members against the elongated member to extend below the bottom of the elongated member so that when raised the cover top engages the bottom of said rod members against the spring bias to prevent rotation of the cover relative to the elongated member.

5. An apparatus according to claim 4, wherein said first means comprises at least one wheel mounted for rotation to said elongated member.

6. An apparatus according to claim 5, wherein said first means comprises a second wheel, said first and second wheels being mounted on opposite sides of the longitudinal axis of said elongated member.

7. An apparatus according to claim 4, wherein said securing means secures the cover at the substantial center of the cover.

8. An apparatus according to claim 4, wherein said securing means secures the cover only at the substantial center of the cover.

* * * * *